United States Patent [19]

Leskovec

[11] 3,961,689

[45] June 8, 1976

[54] SPACER AND NOISE SUPPRESSOR CUSHIONS FOR LIFT TRUCK MAST UNITS

[75] Inventor: Edward V. Leskovec, Eastlake, Ohio

[73] Assignee: Towmotor Corporation, Mentor, Ohio

[22] Filed: Apr. 18, 1975

[21] Appl. No.: 569,513

[52] U.S. Cl. ..... 187/95; 308/3 B; 308/3 C; 308/DIG. 7

[51] Int. Cl.[2] ..... B66B 7/02

[58] Field of Search ..... 295/7; 187/9, 95; 308/3 B, 3 C, DIG. 7, DIG. 8; 214/670–674

[56] References Cited

UNITED STATES PATENTS

| | | | |
|---|---|---|---|
| 1,839,237 | 1/1932 | Lord | 295/7 |
| 2,103,480 | 12/1937 | Mason | 308/3 B |
| 2,490,652 | 12/1949 | Sahlin | 308/3 B |
| 2,743,966 | 5/1956 | McKernan | 308/3 B |

*Primary Examiner*—Robert J. Spar
*Assistant Examiner*—Lawrence J. Oresky
*Attorney, Agent, or Firm*—Phillips, Moore, Weissenberger, Lempio & Strabala

[57] ABSTRACT

A plurality of spacer and noise suppressor cushions employed in a lift truck mast unit between facing beam flanges in relativey movable upright units, the cushions being formed from resilient material while also having an undercut surface to increase their resilience, the spacer and noise suppressor cushions preferably being employed on one side of an upright unit opposite a carriage unit which is movable thereupon.

4 Claims, 2 Drawing Figures

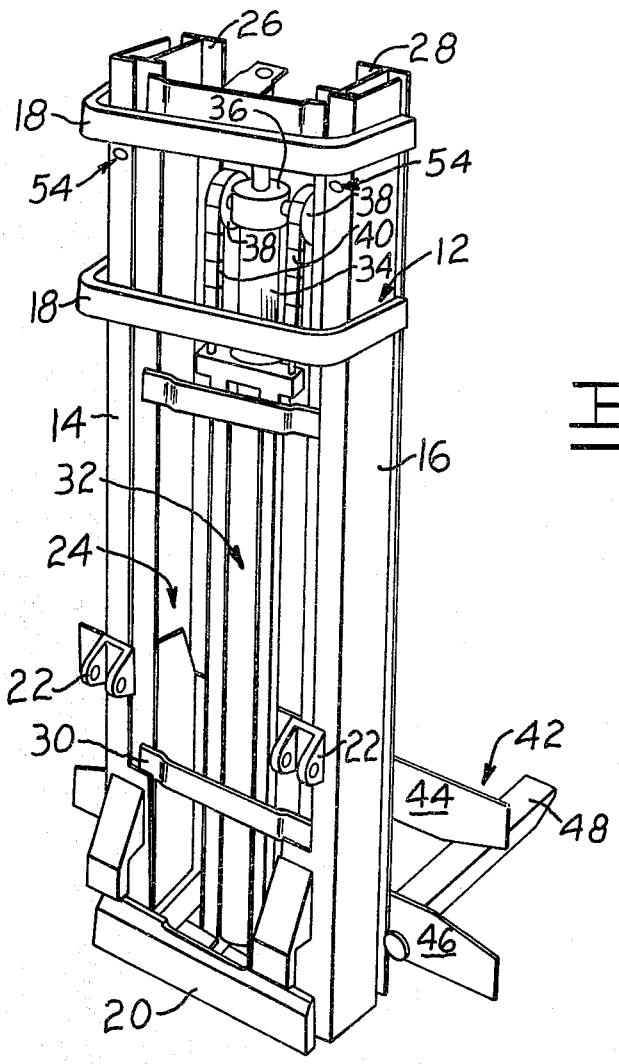
Fig. 1
Fig. 2
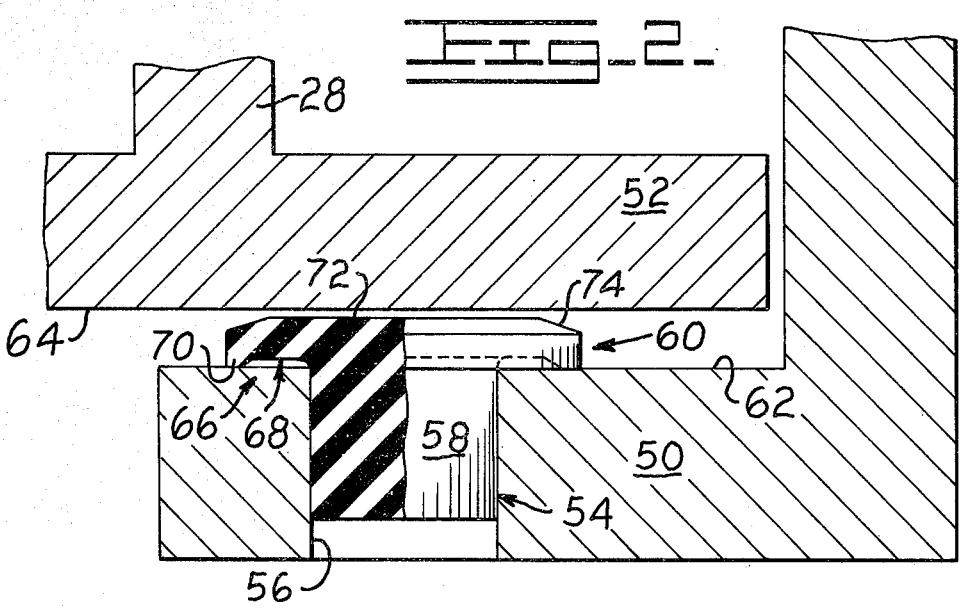

SPACER AND NOISE SUPPRESSOR CUSHIONS FOR LIFT TRUCK MAST UNITS

BACKGROUND OF THE INVENTION

The present invention relates to a novel spacer and noise suppressor cushion used in plural within a lift truck mast unit to prevent undesirable frictional engagement between relatively movable portions of the mast unit while also minimizing or preventing undesirable noise.

Conventional mast units for lift trucks include a fixed upright unit, one or more movable upright units and a carriage assembly arranged for longitudinal movement upon one of the movable upright units. In one particular type of conventional mast unit, a movable upright structure includes a pair of spaced-apart I-beams which are nested within encompassing C-shaped beams of a fixed upright unit. A carriage assembly is arranged upon the movable upright unit for controlled movement from a position generally at ground level up to the combined height of the fixed upright unit and movable upright unit.

During vertical travel of the carriage, the movable upright unit also moves relative to the fixed upright unit. Such relative movement between certain portions of the mast unit is often compensated for by roller bearings to prevent undesirable contact and to minimize noise generation. However, there is often not sufficient space for installation of such rollers so that other bearing means must be employed. In addition, the relative cost for employing roller bearings often dictates the use of other types of bearings.

Accordingly, one solution in the prior art has been the use of spacers formed from ductile materials or metals such as brass to limit relative horizontal movement between various portions of the mast unit. Such spacers have commonly been employed between facing flanges on the fixed upright and movable upright beams, particularly on one side of the movable upright unit opposite the carriage. The use of spacers in such a location is of significant importance, not only to provide smoother operation during relative travel of the movable upright upon the fixed upright unit but also to provide support when the carriage is tilted or racked back upon the entire mast unit to insure that a load is maintained upon the forks of the carriage. At such times, a substantial portion of the carriage load is borne by the facing flanges noted above.

With the carriage and mast unit in such a tilted configuration, further vertical travel of the movable upright unit and carriage places severe stress upon the spacers, commonly resulting in substantial wear and significant noise generation.

SUMMARY OF THE INVENTION

Accordingly, it is an object of the present invention to provide an improved spacer and noise suppressor cushion for use in lift truck mast units, the cushions being configured for increased resilience and noise suppression.

It is a further object of the invention to employ such spacer and noise suppressor cushions particularly between a first mast unit and a movable upright unit on an opposite side from a carriage unit supported thereby.

The increased resilience and noise suppression of the present cushion is due both to its composition of elastomeric material as well as to an undercut configuration designed to enhance resilience.

Additional objects and advantages of the invention are made apparent in the following description having reference to the accompanying drawings.

DESCRIPTION OF THE DRAWINGS

FIG. 1 is an isometric view taken generally from the rear of a lift truck mast unit to illustrate use of the present spacer and noise suppressor cushions.

FIG. 2 is a fragmentary plan view taken in section through a portion of the lift truck mast unit to better illustrate the configuration and manner of installation for one of the spacer and noise suppressor cushions.

DESCRIPTION OF THE PREFERRED EMBODIMENT

The present invention is directed toward a spacer and noise suppressor cushion employed in various locations within a lift truck mast unit of the type indicated generally at 10 in FIG. 1. The mast unit 10 is generally of conventional design except for the present spacer and noise suppressor cushions. Accordingly, the mast unit 10 is described only briefly below primarily for the purpose of facilitating an understanding as to the arrangement and function of the present spacer and noise suppressor cushions thereupon.

The mast unit 10 includes a fixed upright section 12 comprised primarily of C-shaped channel members 14 and 16 which are spaced apart and secured together by various components such as the brackets or cross-pieces indicated at 18 and the lower cross-piece 20. Brackets or trunnion plates 22 are respectively secured to the channel members 14 and 16 for mounting the mast unit upon a suitable lift truck (not shown).

At this point, it may be noted from the preceeding discussion that the present invention is particularly contemplated to function when the carriage is tilted upwardly and rearwardly together with the mast unit. This type of motion is accomplished by shifting of the entire mast unit about a pivot point formed by the brackets 22.

A movable upright unit 24 is arranged between the channel members 14 and 16, the movable upright including a pair of I-beams 26 and 28 which are secured to each other in spaced-apart relation by additional brackets such as those indicated at 30. A number of rollers (not shown) are arranged for bearing interaction between the respective movable I-beams 26, 28 and forward portions of the respective channel members 14, 16. These rollers may be of generally conventional configuration and serve to support the carriage and a load carried thereupon for example, when the movable upright unit tends to be urged forwardly relative to the fixed upright unit.

The movable upright unit 24 is raised relative to the fixed upright 12 by means of a conventional hydraulic jack unit generally indicated at 32 and having a header portion 34. A cross-head 36 is carried above the jack unit by the header 34 to support a pair of rotatable sheaves 38. Chains 40 are trained respectively over the sheaves 38 and extend downwardly for connection with a carriage unit generally at 42.

The carriage unit 42 is also of a conventional configuration including cross-pieces 44 and 46 together with one or more forwardly extending forks such as that indicated at 48. The carriage unit 42 is supported for movement relative to the movable upright unit 24 by means of rollers (not shown).

As was indicated above, the present invention is particularly concerned with spacer means for limiting and controlling rearward movement of the movable upright unit 24 relative to the fixed upright unit 12. Having reference also to FIG. 2, it may be seen that each pair of relatively movable structural beams 14, 26 and 16, 28 has facing flange portions. The flange portions of concern for the fixed beam 16 and the movable I-beam 28 are indicated respectively at 50 and 52 in FIG. 2. The present spacer and noise-suppressor cushion is contemplated for use between the facing surfaces of these flanges as well as between the similar facing surfaces for the fixed beam 14 and the movable I-beam 26. Accordingly, one of the present spacer and noise suppressor cushions is generally indicated upon each side of the lift mast unit in FIG. 1 at 54. The spacer and noise suppressor cushion is also illustrated, both as to configuration and installation, within the enlarged section view of FIG. 2.

Referring now particularly to FIG. 2, each of the flanges 50 for the fixed beam 16 and also for the other fixed beam 14, may be formed with one or more bores. One such bore is indicated at 56 in FIG. 2 to receive one of the spacer and noise suppressor cushions. Each spacer and noise suppressor cushion is formed as a body of elastomeric material having a cylindrical portion 58 sized for press fit engagement within the bore 56. An enlarged portion 60 of the elastomeric body is intended to provide a spacer and noise suppressor cushion between the facing surfaces 62 and 64 for the flanges 50 and 52 respectively.

The enlarged portion of the cushion overlaps the flange surface 62 about the bore 56 to form an annular surface 66. The annular surface 66 is formed with an annular undercut indicated at 68 so that a peripheral rim or lip is formed at 70 for engagement with the surface 62.

The undercut configuration for the enlarged portion of the cushion is intended to further enhance its resilient properties particularly upon encountering the substantial forces produced between the surfaces 62 and 64, for example when the carriage is tilted upwardly and rearwardly together with the mast unit in the manner described above. It may be seen that the undercut configuration of the cushion portion 60 provides a spring effect for this purpose.

In addition, a flat circular surface 72 on the enlarged cushion portion 60 which faces the flange surface 64 is tapered about its periphery as indicated at 74. The tapered periphery 74 tends to further enhance the spring effect for the cushion portion 60 in that compression is more uniformly distrubuted across the annular or overlapping portion of the cushion.

The particular elastomeric material within each cushion 54 may be further selected to resist abrasion and accordingly may be formed from a suitable material such as polyurethane elastomer or polyvinylchloride elastomer, for example.

I claim:

1. In a lift truck mast unit including a fixed upright unit, at least one movable upright unit and a carriage arranged for longitudinal movement relative to the movable upright unit, motor means being operable for moving the carriage relative to the movable upright unit and for shifting the movable upright unit relative to the fixed upright unit, the movable upright unit including a pair of flanged structural beams arranged in spaced-apart relation, the fixed upright unit also including structural beams having flanges arranged in facing relation to the flanges of the movable upright beams, a plurality of spacer and noise suppressor cushions arranged upon the flanges of either the movable upright beams or the fixed upright beams, each spacer and noise suppressor cushion comprising an elastomeric body including a reduced diameter portion secured within a bore formed by one flange, the elastomeric body including another portion having a diameter substantially larger than the bore for arrangement between the one flange and the facing flange, the larger diameter portion of the elastomeric body having an annular surface abutting the one flange about its bore, the annular surface of the elastomeric body portion being circumferentially undercut to form a peripheral rim normally in contact with the surface of the one flange, the larger diameter portion of the elastomeric body thereby exhibiting increased resilience due both to its elastomeric composition and a spring effect due to its undercut configuration.

2. The lift truck mast unit of claim 1 wherein each of the plurality of spacer and noise suppressor cushions is arranged upon a flange of one of the fixed upright beams with its larger diameter portion being arranged adjacent a facing flange on one of the movable upright beams, the plurality of spacer and noise suppressor cushions also being arranged on an opposite side of the movable upright unit relative to the carriage.

3. The lift truck mast unit of claim 1 wherein a facing surface on the enlarged diameter portion of each elastomeric body opposite its annular surface is tapered about its periphery to further increase its resilience.

4. The lift truck mast unit of claim 3 wherein each of the plurality of spacer and noise suppressor cushions is arranged upon a flange of one of the fixed upright beams with its larger diameter portion being arranged adjacent a facing flange on one of the movable upright beams, the plurality of spacer and noise suppressor cushions also being arranged on an opposite side of the movable upright unit relative to the carriage.

* * * * *